US008382647B1

(12) United States Patent
Hodes et al.

(10) Patent No.: US 8,382,647 B1
(45) Date of Patent: Feb. 26, 2013

(54) WEIGHTED EXERCISE DEVICE PROVIDING TWO GRIPS

(76) Inventors: Leon Hodes, Great Neck, NY (US); Leonard Holtz, New York, NY (US)

( * ) Notice: Subject to any disclaimer, the term of this patent is extended or adjusted under 35 U.S.C. 154(b) by 0 days.

(21) Appl. No.: 13/305,179

(22) Filed: Nov. 28, 2011

(51) Int. Cl.
*A63B 21/072* (2006.01)

(52) U.S. Cl. ..... 482/108; 482/141; 482/93

(58) Field of Classification Search ..... 482/44, 482/45, 46, 49, 50, 91, 92, 93, 106, 108, 482/109, 132, 141, 148; D21/662, 679, 680, D21/681, 682, 684, 688, 689, 787, 797
See application file for complete search history.

(56) References Cited

U.S. PATENT DOCUMENTS

| | | | | | |
|---|---|---|---|---|---|
| 113,966 | A | * | 4/1871 | Ballou | 482/108 |
| 2,447,218 | A | * | 8/1948 | Trzesniewski | 482/106 |
| 2,878,858 | A | * | 3/1959 | Winchester | 472/25 |
| 3,185,476 | A | | 5/1965 | Fechner | |
| D203,052 | S | | 11/1965 | Weight | |
| 4,801,140 | A | * | 1/1989 | Bergeron | 482/146 |
| 4,813,669 | A | | 3/1989 | Caruthers | |
| 4,880,228 | A | | 11/1989 | Caruthers | |
| 4,896,880 | A | | 1/1990 | Caruthers | |
| 4,900,016 | A | | 2/1990 | Caruthers | |
| D321,230 | S | * | 10/1991 | Leonesio | D21/682 |
| 5,342,268 | A | * | 8/1994 | Caruthers | 482/108 |
| D383,646 | S | * | 9/1997 | Jeppesen et al. | D7/584 |
| 5,853,355 | A | * | 12/1998 | Standish | 482/106 |
| 6,001,049 | A | * | 12/1999 | Frey | 482/105 |
| D432,602 | S | * | 10/2000 | Savage | D21/681 |
| 6,672,993 | B2 | * | 1/2004 | Stout | 482/55 |
| 7,300,389 | B2 | * | 11/2007 | Lien et al. | 482/106 |
| D565,356 | S | * | 4/2008 | Mellen et al. | D7/586 |
| 7,585,262 | B1 | | 9/2009 | Vayntraub | |
| D616,949 | S | * | 6/2010 | Wang | D21/682 |
| 2003/0134727 | A1 | * | 7/2003 | Yu | 482/110 |
| 2007/0142188 | A1 | * | 6/2007 | Lien | 482/93 |

OTHER PUBLICATIONS http://www.dragondoor.com/shop-by-department/equipment/ Accessed by Applicants on Nov. 22, 2011 at 3:56 PM.
http://www.fitter1.com/Catalog/Items/BBELL.aspx Accessed by Applicants on Nov. 28, 2011 at 2:21 PM.
http://www.bosu.com/scripts/cgiip.exe/WService=BOSU/itemdetl.html?item=BOSU_Sport_45&lvl1=1&lvl2=HEquip Accessed by Applicants on Nov. 28, 2011 at 3:03 PM.

* cited by examiner

*Primary Examiner* — Loan Thanh
*Assistant Examiner* — Sundhara Ganesan
(74) *Attorney, Agent, or Firm* — Holtz, Holtz, Goodman & Chick, PC

(57) ABSTRACT

Weighted exercise device includes a generally hemispherical body defining a hollow cavity opening at a first edge of the body, and an outwardly projecting rim arranged on the body proximate to the first edge. A handle is arranged in the cavity. The rim provides a first grip during use of the device and the handle provides a second grip during use of the device. By providing two different grips on the same weighted device, and due to the symmetrical rounded shape, with a low center of gravity, the weight is evenly distributed around a user's hands, and a user can safely and efficiently perform a larger variety of exercises in comparison to using conventionally shaped exercise devices that include only a single type of grip.

21 Claims, 5 Drawing Sheets

WEIGHTED EXERCISE DEVICE PROVIDING TWO GRIPS

FIELD OF THE INVENTION

The present invention relates generally to a weighted device for use in exercising, and more particularly to generally hemispherical weighted exercise devices for use in exercising and which can be gripped in two different ways to thereby enable their use for a wide range of exercises.

BACKGROUND OF THE INVENTION

Dumbbells are often used in muscle-building or muscle-toning exercises. However, a traditional dumbbell, i.e., a pair of weights connected by a short bar serving as a handle, is not appropriate for all exercises and alternative forms of weights have been developed for different exercises.

One weighted exercise device that was considered to be particularly useful for gymnastic exercises is disclosed in U.S. Pat. No. 113,966 (Ballou) and comprises a spherical or spheroidal lower part that is elongated or extended on one side. The weighted exercise device includes a hollow cavity and includes an opening in the elongated or extended part leading into the cavity. A handle extends across the cavity and is positioned to enable a user to extend their hand into the cavity and grasp the handle. The only manner in which this weighted exercise device may be used is by gripping the handle Other weighted exercise devices include those disclosed in U.S. Pat. Nos. 4,813,669; 4,880,228; and 4,900,016 (all to Caruthers).

Another exercise device is a Bosu® balance trainer that has a rim that can be gripped. This balance trainer is constructed of rubber and plastic and is not weighted.

OBJECTS AND SUMMARY OF THE INVENTION

It is an object of the present invention to provide a weighted device for use in exercising.

A weighted exercise device in accordance with the invention includes a generally hemispherical body defining a hollow cavity opening at a first edge of the body. The body has a hemispherical portion and a tubular portion extending to one side of the hemispherical portion. A rim is arranged on the tubular portion of the body. A handle is arranged in the cavity. The rim provides a first grip for a user during use of the exercise device and the handle provides a second grip for the user during use of the exercise device.

Another way to consider the exercise device in accordance with the invention is as one that includes a generally hemispherical body defining a hollow cavity opening at a first edge of the body, a first grip arranged in connection with the body and adapted to be gripped by one or both hands of a user, and a second grip arranged in the cavity and adapted to be gripped by only one hand of the user.

By providing two different grips on the same weighted exercise device, a user can perform a larger variety of exercises using the invention in comparison to exercise devices that include only a single type of grip.

The generally hemispherical shape provides a better, safer, and more efficient exercise experience than traditional dumbbells.

The other objects of the present invention are attained in accordance with the weighted exercise device of the present invention which are described hereinafter.

BRIEF DESCRIPTION OF THE DRAWINGS

The invention, together with further objects and advantages thereof, may best be understood by reference to the following description taken in conjunction with the accompanying drawings, wherein like reference numerals identify like elements.

DETAILED DESCRIPTION OF THE INVENTION

Figure 1:
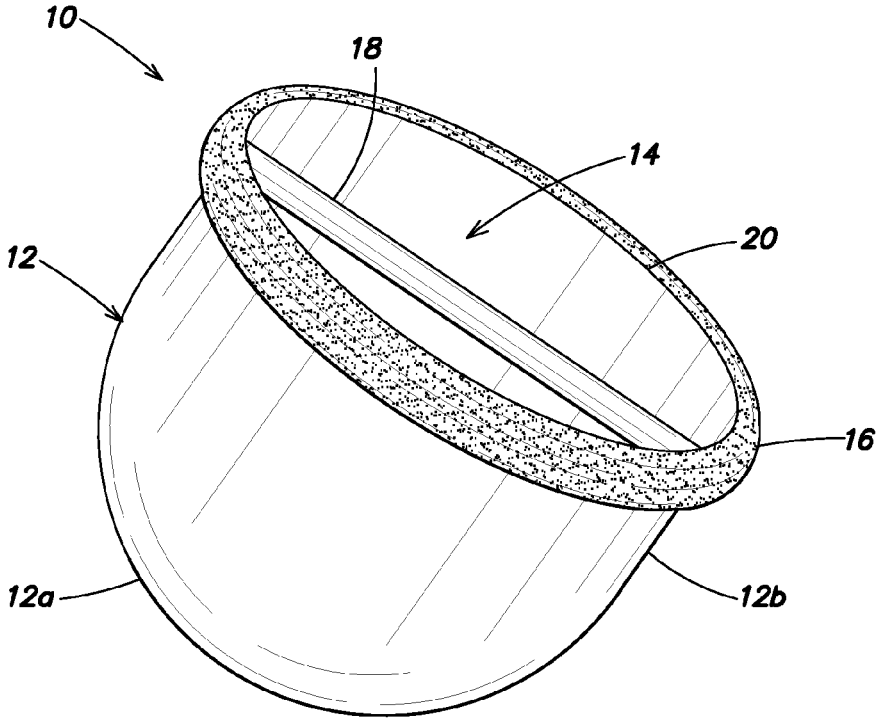
FIG. 1 is a perspective view of a first embodiment of a weighted exercise device in accordance with the invention.

Referring to the accompanying drawings wherein like reference numerals refer to the same or similar elements, a weighted exercise device in accordance with the invention is designated generally as 10 and includes a generally hemispherical body 12 defining a hollow cavity 14 and having a rim 16 adjacent its upper edge 20 (the top edge 20 when the weighted exercise device is positioned as shown in FIG. 1). By being generally hemispherical, it is preferred that the body 12 has a generally hemispherical portion 12*a* and a small extended or elongated portion (tubular portion) 12*b* extending from the generally hemispherical portion 12*a* (see FIGS. 1 and 4). Body 12 thus has a generally acorn shape. The extended or elongated portion 12*b* is tubular in view of the formation of part of the cavity 14 therein.

Figure 4:
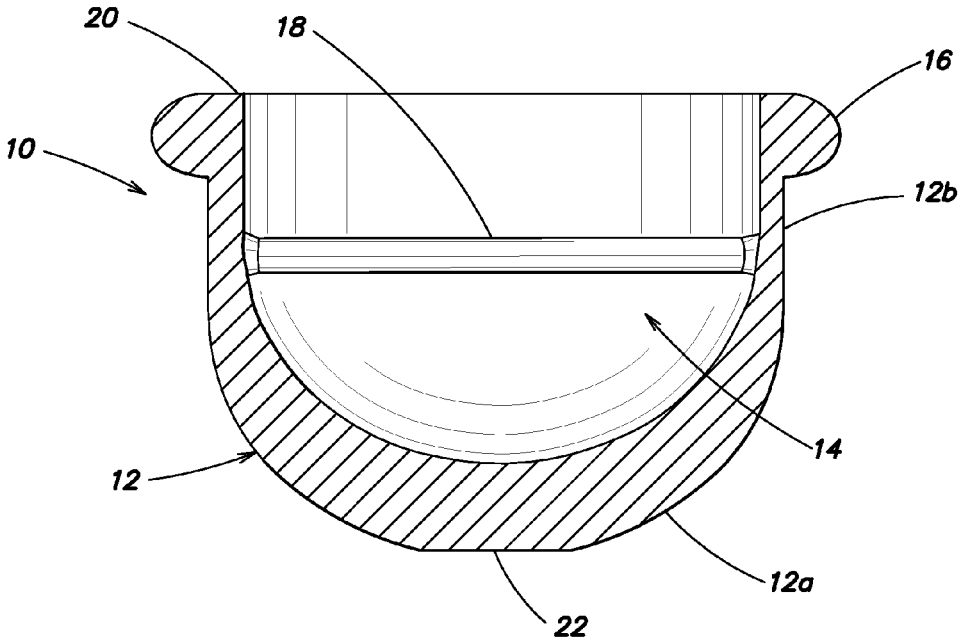
FIG. 4 is a cross-sectional view of the weighted exercise device shown in FIG. 1.

The rim 16 preferably extends around the entire circumference of the body 12 (see FIG. 1) and more particularly, is situated on the extended or elongated portion 12*b* of the body 12 (see FIG. 4). Rim 16 may either be considered an integral part of the body 12 or a separate part that is connected to the body 12.

The outer surface of the body 12 is provided with a unique shape in view of the presence of the projecting rim 16. At the bottom edge, the outer surface of the body 12 has a substantially hemispherical portion (in portion 12*a*), then has a generally cylindrical surface portion (in portion 12*b*) and then an outwardly projecting rounded portion (rim 16). This unique shape is partially shown in FIG. 4. The thickness of the tubular portion 12*b* is preferably uniform so that the cylindrical surface portion does not taper inward.

The size of the extended or elongated portion 12*b* of the weighted exercise device 10 may be dependent on, for example, the size of the hands of the user intended to use the weighted exercise device 10. The size of the extended or elongated portion 12*b* also affects the size of the cavity 14, i.e., a larger extended or elongated portion 12*b* results in a larger cavity 14. The weighted exercise device 10 should accommodate most users. However, a user with unusually large hands may prefer a weighted exercise device 10 that has a larger extended or elongated portion 12*b* and thus a larger cavity 14 than a user with smaller hands. Different size weighted exercise devices 10 may be manufactured with different weights. The larger weights would be of larger size. A set of different-weight exercise devices 10 could be assembled together and sold as a unit.

Rim 16 is preferably rounded and beveled (see FIG. 4), and serves as a hand grip for a user to grip or grasp the weighted exercise device 10 with one or two hands when performing an exercise. Rim 16 is therefore a first grip of the weighted exercise device 10. Most often, the user would grip or grasp the rim 16 with both of their hands when performing an exercise, although the user could also grip or grasp the rim 16 with only one of their hands for certain exercises.

A second grip of the weighted exercise device 10 is provided by a handle 18 that extends across the hollow cavity 14 formed in the hemispherical body 12. Handle 18 is substantially cylindrical, or may be tubular, and is preferably rigid. Handle 18 may be formed integral with the body 12 or separated therefrom and then attached to the body 12 in a preferably permanent manner, e.g., by welding.

Handle 18 may be positioned a distance inward from the top edge 20 of the hemispherical body 12, i.e., recessed within the cavity 14. Handle 18 is also spaced a distance from the bottom of the cavity 14 so that the user's fingers have room to pass freely around the handle 18 and grasp it comfortably.

The recess distance varies depending, for example, on the size and weight of the weighted exercise device 10 (see FIG. 4). This distance may be determined during design of the weighted exercise device 10 in consideration of the location of the center of gravity of the weighted exercise device 10. More specifically, in one embodiment, it is desirable for the handle 18 to be close to or at the center of gravity of the device. As such, when one of the user's hands is gripping the handle 18, the center of gravity is close to where the hand is, thereby providing a safer and more balanced exercise experience.

On the other hand, when the user is using the rim 16 as the grip, and using both hands as in a preferred use, the center of gravity is away from the user's hands for performing certain exercises.

Figure 2:
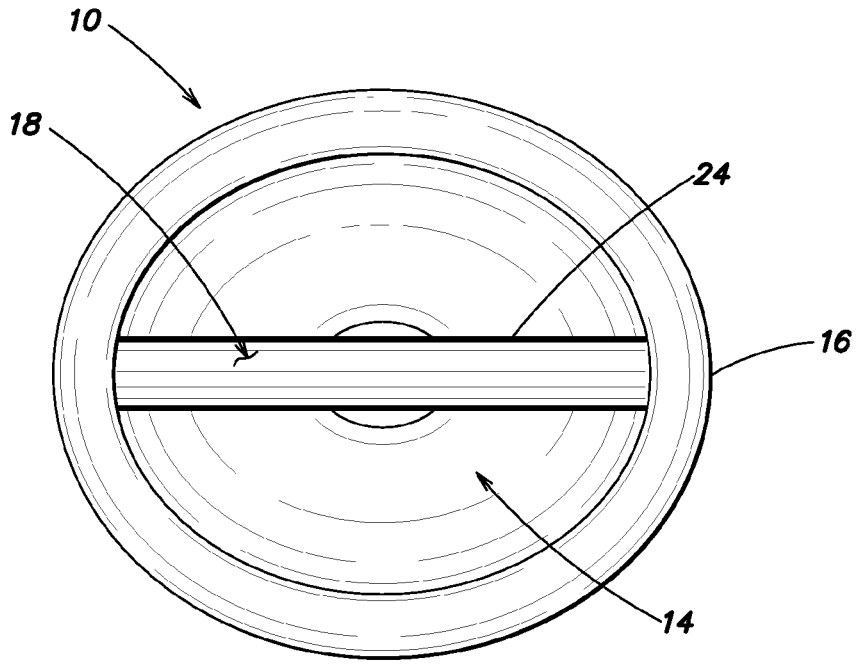
FIG. 2 is a top view of the weighted exercise device shown in FIG. 1.
Figure 6:
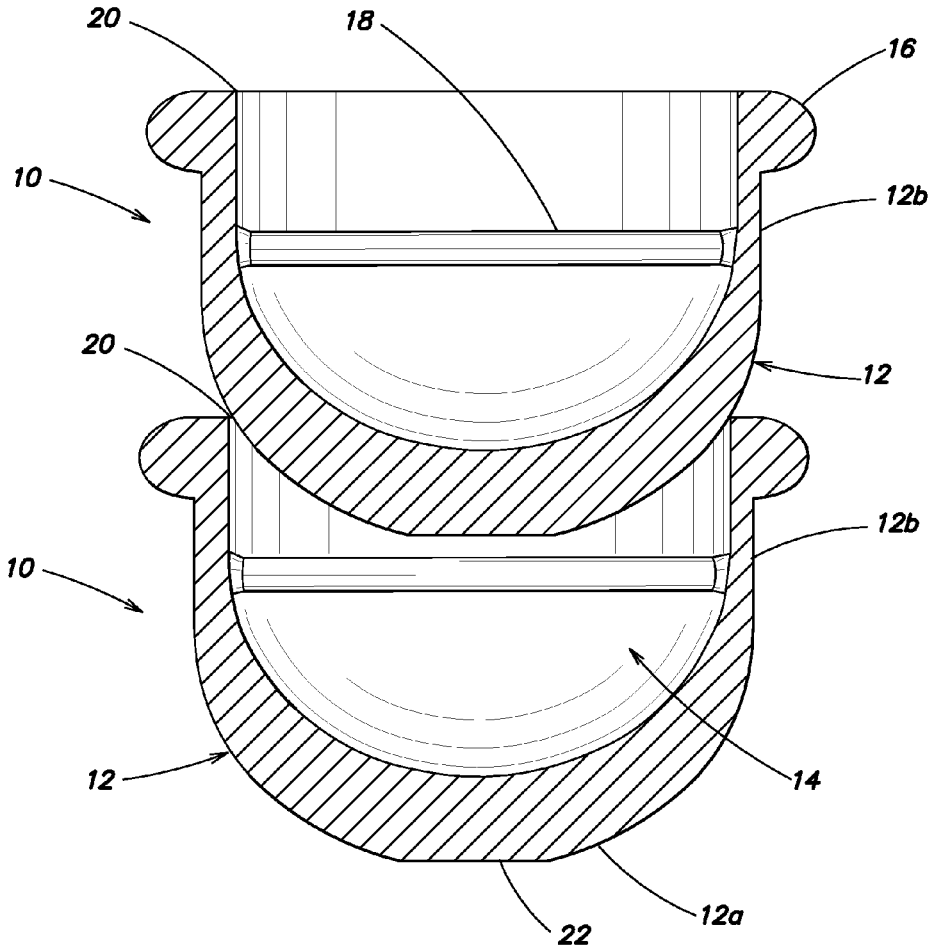
FIG. 6 shows two stacked exercise devices.

As shown in FIG. 6, an advantage of the recessing of the handle 18 in the cavity 14 is that the weighted exercise device 10 is thus stackable, i.e., multiple weighted exercise devices 10 may be stacked one on top of another with, in each adjacent pair of weighted exercise devices, a portion of an upper weighted exercise device sitting in the cavity 14 defined by a lower weighted exercise device. More than two devices could be stacked. A convenient space saving design is therefore provided. Handle 18 is optionally provided with a coating 24 on its outer surface to provide a better and/or more comfortable grip to the user (see FIG. 2). The coating 24 may be made of rubber, or any other material that improves the grip, and may be textured or grooved. Alternatively, the outer surface of the handle 18 itself may be textured or grooved to improve the user's grip thereof.

Figure 3:
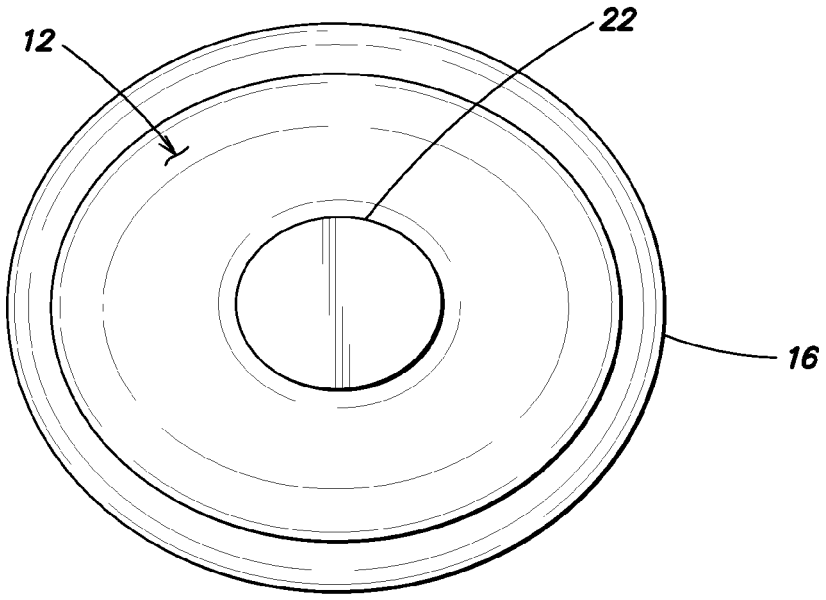
FIG. 3 is a bottom view of the weighted exercise device shown in FIG. 1.

Referring now in particular to FIGS. 3 and 4, the generally hemispherical body 12 also includes a slightly flattened area 22 at a bottom, i.e., encompassing the bottom edge, in order to enable the weighted exercise device 10 to be stably placed onto a flat horizontal surface. Flattened area 22 is not required to be completely flat, and it may just be tapered. Its presence enables the weighted exercise device to be balanced and rest upright, in the position shown in FIG. 4, if placed carefully on a floor or other horizontal surface. The flattened area 22 also enables the user to do push-up type exercises, rotate one's hands, and/or rotate his body while exercising, thereby utilizing core muscles. This can be done with one device, where the user grips the one device with two hands, or this can be done with two devices, where the user grips one device in each hand.

Figure 5:
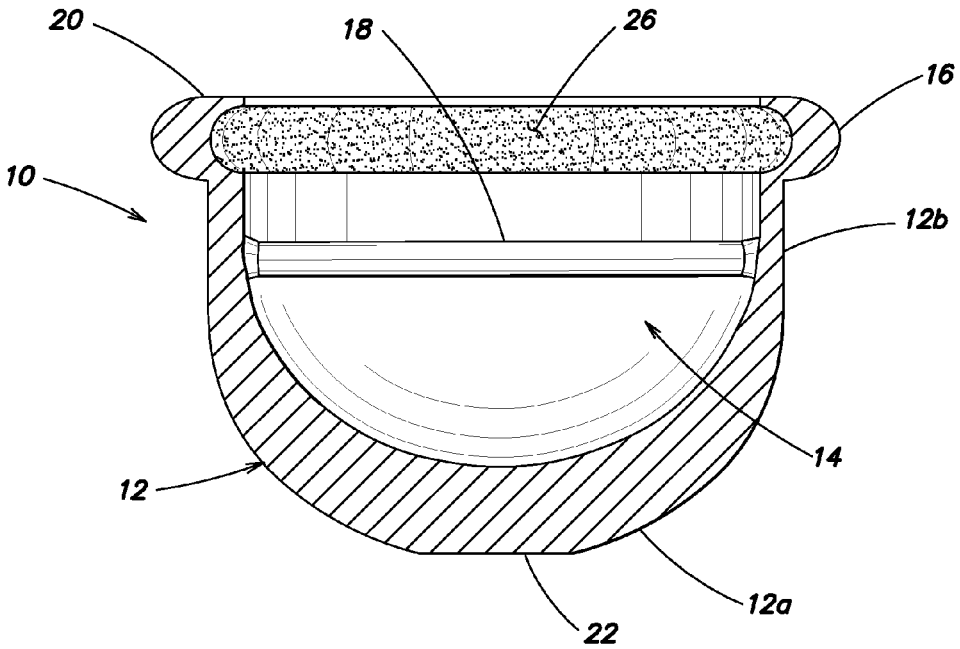
FIG. 5 is a cross-sectional view of a second embodiment of a weighted exercise device in accordance with the invention.

Variations to the shape and/or form of the weighted exercise device 10 described above are envisioned. For example, the outer surface of the rim 16 may be textured (as shown in FIG. 1) and/or an interval groove 26 may be arranged in connection with the rim 16. FIG. 5 shows such a groove 26 having a generally semi-circular cross-section which is formed opposite or in the rim 16. In use, groove 26 may accommodate a thumb of the user while handling or lifting the weighted exercise device 10 so that the user is better able to handle the weighted exercise device 10 by placing the thumb on the inside of the body 12 and the remaining fingers around the projecting rim 16 on the outside of the body 12. The surface of the groove 26 may be textured in the same manner as shown for the rim 16 in FIG. 1. In this case, the rim 16 is more securely gripped between the thumb on the inside thereof and the remaining fingers on the outside thereof.

The weighted exercise device 10, in any of its forms and shapes described above, may be used for a wide variety of exercises, only some of which are identified herein. For example, the weighted exercise device 10 may be used as traditional dumbbells in pairs to perform bicep curls, clean and jerky movements, military presses, bench presses, or swinging type exercises typically performed with kettlebells. In addition, the weighted exercise device 10 may be used for floor exercises, such as push-ups, using either a single weighted exercise device with the user's two hands gripping the rim 16 or two weighted exercise devices 10 with each of the user's hands gripping the handle 18 of a respective weighted exercise device 10.

The weighted exercise device 10 may also be used for wrist and forearm rehabilitation exercises with the user grasping the handle 18, positioning the flattened area 22 against a flat surface, and turning the weighted exercise device 10 to either side on the flat surface. The weighted exercise device 10 could be rotated and turn on the rim 16.

Furthermore, the weighted exercise device 10 can be used by a user, while standing or sitting, and for floor exercises because they are designed to be used for the same exercises that involve traditional dumbbells and kettlebells. For example, when performing push-up type exercises, the user can rotate and pivot, and can shift his body weight. These actions utilize core and stabilization muscles thereby providing a highly efficient exercise for the user using the weighted exercise device 10. The device of the present invention takes the place of both dumbbells and kettlebells.

The weight of the weighted exercise device 10 is provided primarily by the hemispherical body 12, along with a smaller contribution to the weight by the handle 18. To this end, the body 12 is provided with a thickness and material composition to provide a desired weight, e.g., 1 lb, 2 lb, 5 lb or more. If the same material is used, the weighted exercise device is larger as the weight increases. With smaller weights, for example a 5 lb weight, the slight elongation to a slightly oval shape (see FIGS. 2 and 3) will ensure more space in the cavity 14. Sets of weighted exercise devices 10 may be assembled with different weights of the weighted exercise devices, e.g., from 1 lb to about 15 lbs with increments of 1, 2 or 3 lb. Higher weights, such as 20 lb, 25 lb, 30 lb, 35 lb, 40 lb, and 50 lb or more can also be made. A mark or indication of the weight of each weighted exercise device in the set may be placed on the body 12 in an easily visible location. As the weights get heavier, the device has another advantage: because the device is generally hemispherical, the weight is evenly distributed and is easier and safer to handle. Moreover, the size is not as large as conventional dumbbells, thereby being easier to use, especially in pairs.

Figure 7:
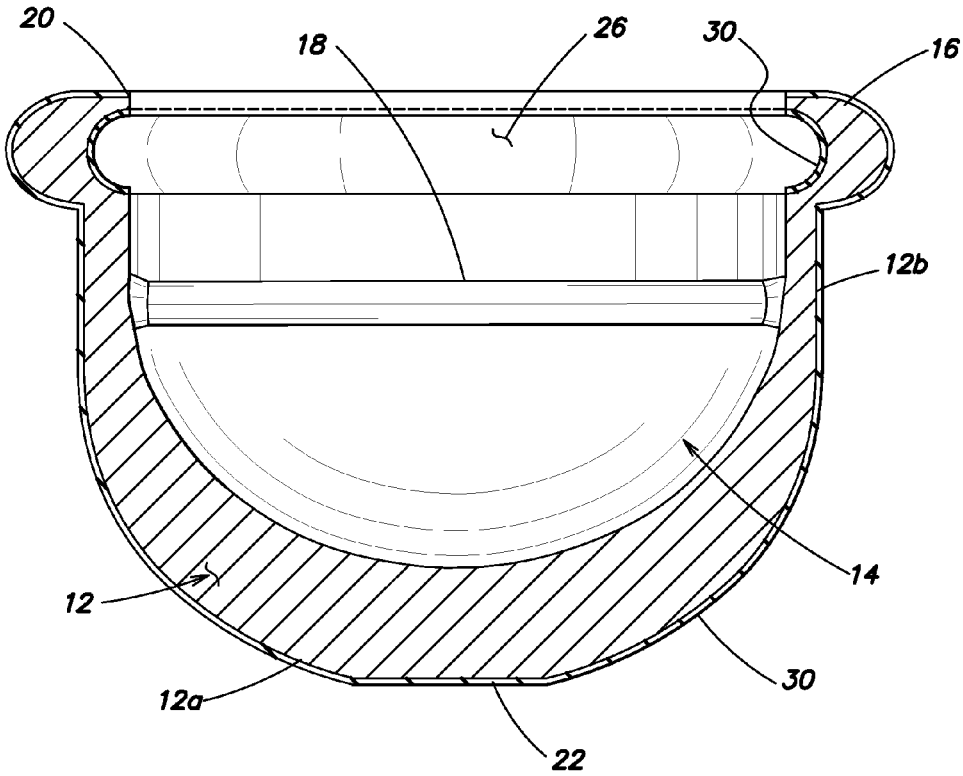
FIG. 7 shows an embodiment with a rubberized coating.

In another embodiment, as shown in FIG. 7, the outer surface of the weighted exercise device 10, i.e., the outer surface of the body 12 and/or rim 16, is rubberized and/or color-coded. Rubberizing the weighted exercise device 10 (i.e., by providing a thin outer rubber-like coating 30 on the entire device) enables two or more of the weighted exercise devices 10 to be stacked together (as in FIG. 6) without allowing metal-to-metal contact. Further, the rubber coating on the outer surface of the body 12 and/or rim 16 prevents damage to surfaces against which the weighted exercise device 10 is used, e.g., flooring or furniture. Instead of a rubber material, a plastic material could be used for the coating 30. In one embodiment, is possible to only color the rim 16 so that different colored rims are provided in a set of weighted exercise devices. A mark or indication of the weight of each weighted exercise device may be placed on the colored rim.

The rubberized or rubber-like coating 30 on the groove 26 improves gripping by the user.

Weighted exercise device 10 may be made from a single piece of cast iron or other similar, heavy density material. The casting process may be designed to provide the body 12 with the cavity 14 and rim 16. The handle 18 may either be formed during the casting or formed separately and attached to opposed portions of the inner surface of the body 12 at the desired distance from the top edge 20 of the body 12. The groove 26 may also be formed in the casting or molding. Casting is not the only manner in which the weighted exercise device 10 may be formed but is only an exemplifying method. One skilled in the art would readily understand how to manufacture the weighted exercise device 10 using other material processing techniques from the disclosure herein.

The weighted exercise devices 10 described above constitute an improvement over prior art weighted exercise devices in that they have two grips or gripping portions, one defined by the rim 16 (with or without groove 26) and another defined by the handle 18. The presence of these two gripping portions significantly increases the functionality of the weighted exercise device 10 because while a weight with a handle intended to be gripped by one hand of a user enables a limited number of exercises to be performed and a weight with a grip intended to be gripped by both hands of the user enables another limited number of different exercises to be performed, by providing both types of grips in a single weighted exercise devices, all of the exercises using either type of grip can be performed using only the weighted exercise device in accordance with the invention.

The weighted exercise devices of the present invention provide an advantage over traditional dumbbells in that they are substantially hemispherically shaped, which provides a symmetrical device, wherein the weight is substantially evenly distributed circumferentially around the handle 18 as compared to a conventional dumbbell wherein the weight is concentrated on two sides of a gripping bar portion. This is an important distinction for certain exercises in order to prevent injury, particularly for exercises where the weight is lifted above the head. The exercise device of the present invention has a symmetrical, circumferentially distributed weight, and provides a safer exercise experience.

The weighted exercise device of the present invention can be used as both a kettlebell and a traditional dumbbell. Also, the weighted exercise devices of the present invention can be used with the outer rounded portion on the floor to pivot and rotate while the handle 18 is being gripped by the user so as to more efficiently use the core muscles in a way that either kettlebells or dumbbells cannot. The weighted exercise device of the present invention can also be used more safely as a swinging device since there are no outwardly projecting members (as in conventional dumbbells or kettlebells). The rounded substantially hemispherical shape provides a smooth curved outer surface that reduces the possibility of injury to the user when using the weights while performing a swinging exercise, or when using the weights in an aerobic class or the like. Users can more safely use the device to perform a plethora of exercises without having to change devices.

The present invention therefore is a weighted exercise device that improves on existing weighted exercise devices by expanding possible uses thereof thereby increasing the number of exercises that can be performed with the weighted exercise device and improving safety for the user.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. An exercise device, comprising:

a main body defining a hollow cavity opening at a first edge thereof;

an outwardly projecting rim arranged on said body proximate said first edge and projecting outwardly past an outer surface of said body; and a handle arranged in said cavity;

wherein said rim provides a first grip for a user during use of the exercise device and said handle provides a second grip for the user during use of the exercise device; and wherein said main body further comprises a groove arranged in an inner surface defining said cavity and opposite said rim.

2. The exercise device of claim 1, wherein said main body has a generally hemispherical portion and a tubular portion extending to one side of said generally hemispherical portion, said tubular portion opening at said first edge, and said rim being arranged on said tubular portion and projecting outwardly past an outer surface of said tubular portion.

3. The exercise device of claim 2, wherein said tubular portion of said main body has a substantially uniform thickness.

4. The exercise device of claim 1, wherein said rim extends around an entire circumference of said main body alongside said first edge of said main body and projects outwardly in a radial direction from an area proximate said first edge of said main body.

5. The exercise device of claim 1, wherein said rim is rounded.

6. The exercise device of claim 1, wherein said handle is spaced from said first edge of said main body such that said handle is recessed within said cavity.

7. The exercise device of claim 1, wherein said main body includes a flattened area at a side thereof opposite said first edge.

8. The exercise device of claim 7, wherein said flattened area is provided at a tapered portion of said main body.

9. The exercise device of claim 1, wherein said rim is integral with said main body.

10. An exercise device, comprising:

a generally hemispherical body defining a hollow cavity opening at a first edge of said body;

a first grip arranged on said body and adapted to be gripped by one or both hands of a user, wherein said first grip is arranged proximate said first edge and projects outwardly past an outer surface of said body; and a second grip arranged in said cavity and adapted to be gripped by a hand of the user;

wherein said body further comprises a groove arranged in an inner surface defining said cavity and opposite said first grip.

11. The exercise device of claim 10, wherein said first grip projects outwardly in a radial direction from an area proximate said first edge of said body.

12. The exercise device of claim 10, wherein said second grip comprises a handle.

13. The exercise device of claim 10, wherein said body has a generally hemispherical portion and a tubular portion extending to one side of said generally hemispherical portion, said tubular portion opening at said first edge, and said first grip being arranged on said tubular portion and projecting outwardly past an outer surface of said tubular portion.

14. The exercise device of claim 13, wherein said tubular portion of said body has a substantially uniform thickness.

15. The exercise device of claim 10, wherein said first grip extends around an entire circumference of said body alongside said first edge of said body.

16. The exercise device of claim 10, wherein said second grip is spaced from said first edge of said body such that said second grip is recessed within said cavity.

17. The exercise device of claim 10, wherein said body includes a flattened area at a side thereof opposite said first edge.

18. The exercise device of claim 10, wherein said first grip is integral with said body.

19. The exercise device of claim 1, wherein an inner peripheral edge of said opening at said first edge of said main body is arranged to contact an outer peripheral surface of a main body of another one of said exercise device when said another one of said exercise device is received in said opening at said first edge of said exercise device.

20. An exercise system comprising:

a first exercise device as according to claim 1; and a second exercise device as according to claim 1;

wherein:

said opening at said first edge of said main body of said first exercise device is dimensioned to receive said second exercise device therein, at least a part of said second exercise device being receivable in said cavity of said first exercise device; and an inner peripheral edge of said main body at said opening of said first exercise device is arranged to contact an outer peripheral surface of said main body of said second exercise device when said second exercise device is stackably received in said first exercise device.

21. The exercise system of claim 20, wherein said main body of each of said first exercise device and said second exercise device comprises a flattened area opposite to said opening at said first edge to stabilize said exercise devices when in a stacked configuration.

* * * * *